US008161961B2

(12) United States Patent
Freese et al.

(10) Patent No.: US 8,161,961 B2
(45) Date of Patent: Apr. 24, 2012

(54) GAS-HEATED LAUNDRY DRYER HAVING A HEATING DEVICE

(75) Inventors: Heinz Freese, Utrecht (NL); Wolfhard Jording, Loehne (DE); Wiebke Riedel, Borgholzhausen (DE); Frank Schiwy, Guetersloh (DE)

(73) Assignee: Miele & Cie. KG, Guetersloh (DE)

( * ) Notice: Subject to any disclaimer, the term of this patent is extended or adjusted under 35 U.S.C. 154(b) by 682 days.

(21) Appl. No.: 12/301,136

(22) PCT Filed: May 17, 2006

(86) PCT No.: PCT/EP2006/004636

§ 371 (c)(1),
(2), (4) Date: Nov. 17, 2008

(87) PCT Pub. No.: WO2007/131531

PCT Pub. Date: Nov. 22, 2007

(65) Prior Publication Data

US 2009/0183386 A1 Jul. 23, 2009

(51) Int. Cl.
*H01H 61/013* (2006.01)
*D06F 58/26* (2006.01)

(52) U.S. Cl. ..... 126/248; 126/91 A; 431/116; 431/242; 431/354; 432/105

(58) Field of Classification Search ..... 126/248; 431/105, 243, 351
See application file for complete search history.

(56) References Cited

U.S. PATENT DOCUMENTS

| | | | | |
|---|---|---|---|---|
| 1,311,235 | A | 7/1919 | Kemp | |
| 2,898,874 | A * | 8/1959 | Crewdson, Jr. | 239/402.5 |
| 3,285,589 | A | 11/1966 | Joseph | |
| 3,291,467 | A * | 12/1966 | Erickson | 432/105 |
| 3,325,908 | A | 6/1967 | William | |
| 3,497,849 | A * | 2/1970 | Place et al. | 337/99 |
| 3,826,607 | A * | 7/1974 | Kuhn | 432/105 |
| 4,416,613 | A * | 11/1983 | Barisoff | 431/243 |

(Continued)

FOREIGN PATENT DOCUMENTS

DE 1217327 5/1966

(Continued)

OTHER PUBLICATIONS

International Search Report for International No. PCT/EP2006/004636 mailed on Apr. 25, 2007.

*Primary Examiner* — Steven B McAllister
*Assistant Examiner* — Nikhil Mashruwala
(74) *Attorney, Agent, or Firm* — Leydig, Voit & Mayer, Ltd.

(57) ABSTRACT

A gas-heated laundry dryer having a heating device. The heating device includes a gas burner, a valve with a gas nozzle configured to supply primary air for formation of a flame and a tubular heating channel configured to enclose the flame. The tubular heating channel includes an inlet opening configured to receive secondary air as combustion air and an outlet opening configured to receive tertiary air mixable with hot gases of the burner. The outlet opening is connected to a process air duct of the laundry dryer. An annular baffle member is disposed in the outlet opening of the heating channel and configured to center, by the secondary and tertiary air, at least one of the flame and a hot air stream in the channel.

16 Claims, 4 Drawing Sheets

U.S. PATENT DOCUMENTS

| | | | | |
|---|---|---|---|---|
| 6,918,194 | B2 * | 7/2005 | Freese et al. | 34/604 |
| 6,935,048 | B2 * | 8/2005 | Park et al. | 34/132 |
| 7,410,288 | B1 * | 8/2008 | Kelso et al. | 366/341 |
| 2004/0123487 | A1 | 7/2004 | Han | |

FOREIGN PATENT DOCUMENTS

| | | | |
|---|---|---|---|
| DE | 19633505 | * | 2/1997 |
| DE | 19925276 | | 12/2000 |
| DE | 10332338 | | 2/2005 |
| DE | 10332339 | | 2/2005 |
| EP | 0761863 | | 3/1997 |
| FR | 1397357 | | 8/1965 |
| GB | 712008 | | 7/1954 |
| WO | WO 0039504 | * | 6/2000 |
| WO | 03021029 | | 3/2003 |

* cited by examiner

GAS-HEATED LAUNDRY DRYER HAVING A HEATING DEVICE

CROSS REFERENCE TO PRIOR RELATED APPLICATIONS

This application is a U.S. National Phase application under 35 U.S.C. §371 of International Application No. PCT/EP2006/004636, filed May 17, 2006. The international Application was published in German on Nov. 22, 2007 as WO 2007/131531 under PCT article 21 (2).

FIELD

The present invention is related to a gas heated laundry dryer having a heating device including a gas burner and a valve with a gas nozzle.

BACKGROUND

U.S. Pat. No. 3,291,467 describes a laundry dryer which is equipped with a gas-heated heating device for heating the process air stream. The burner of the heating device is disposed upstream of the inlet opening of a heating channel. The heating channel is inclined upwardly so as to follow the natural orientation of the flame. In the burner of this laundry dryer, primary air is mixed with the gas as combustion air upstream of the burner surface, and secondary air is added at the inlet of the heating channel. At the outlet of the heating channel, tertiary air is added to the hot gas and passed as a process air stream through the drum.

In this burner, combustible gas and air are partially premixed. The so-called "primary air" is drawn in by the injector effect of the gas nozzles. The secondary air portion and the tertiary air portion are drawn in by the process air fan. The secondary air enters the heating channel at the burner head, forming an envelope around the flame so as to prevent contact of the flame with the walls of the heating channel or combustion chamber, and thus to prevent heat transfer to the housing. The tertiary air enters at the end of the flame through holes in the shell of the heating channel. The tertiary air holes are arranged in the lower half-shell relative to the cross section of the heating channel, thereby preventing contact of the flame with the wall of the heating channel. The tertiary air further serves to reduce the temperature of the hot air at the entrance to the process air duct to the temperature of the process air. The gas supply is controlled by a valve and a pilot-flame- or spark-monitoring control system. It has been found that in spite of the constructional features, such as the upwardly inclined orientation of the heating channel and the arrangement of the tertiary air supply in the lower half-shell in the region of the flame end, it is still not possible to achieve a combustion with particularly low pollutant emissions.

German documents DE 103 32 338 A1 and DE 103 32 339 A1 describe a heating device for a laundry dryer, which has a first heating channel and a second heating channel. Both heating channels are circular in cross section, the second heating channel having an enlarged cross section compared to the first heating channel. The head of the burner projects into the inlet opening of the first heating channel, the axial centerline of the burner being located below the centerline of the first heating channel. The outlet opening of the first heating channel projects eccentrically into the inlet opening of the second heating channel in downwardly offset relationship therewith. Due to this feature, the inlet opening for the tertiary air is formed principally at the upper side of the second heating channel. In this manner, the hot gases, which issue from the first heating channel and which flow upwardly due to thermal buoyancy, can better mix with the tertiary air in the upper region of the second heating channel. The first heating channel further has a guide device for secondary air which enters through the inlet opening, said guide device extending at a downward slope in flow direction from a middle upper portion of the first heating channel to the outlet opening thereof. This feature reduces the thermal buoyancy of the flame, causing the flame to be directed downwardly at the end of the first heating channel. This results in a combustion with reduced pollutant and noise emissions.

A similar gas-heated laundry dryer having a heating device is described in U.S. Pat. No. 3,826,607. In that disclosure, there are also provided two heating channels, the outlet opening of the first heating channel, into which opens the flame opening of the burner, having a smaller cross section than the inlet opening of the second channel, and the outlet opening of the first channel projecting into the second channel.

However, the construction including a first heating channel and a second heating channel requires greater effort during manufacture and during installation of the heating device in a laundry dryer. The separate subassembly formed by the first and second heating channels must be accurately aligned with respect to the burner during assembly in order to obtain the desired air flow.

SUMMARY

An aspect of the present invention is to provide a gas-heated heating device which allows heating to be effected with low emissions of pollutants and noise and which is relatively simple to manufacture. Another, alternative aspect is that the heating device be installable in a laundry dryer with minimum effort.

In an embodiment, the present invention provides a gas-heated laundry dryer having a heating device. The heating device includes a gas burner, a valve with a gas nozzle configured to supply primary air for formation of a flame and a tubular heating channel configured to enclose the flame. The heating channel includes an inlet opening configured to receive secondary air as combustion air and an outlet opening configured to receive tertiary air mixable with hot gases of the burner. The outlet opening is connected to a process air duct of the laundry dryer. An annular baffle member is disposed in the outlet opening of the heating channel and configured to center, by the secondary and tertiary air, at least one of the flame and a hot air stream in the channel.

BRIEF DESCRIPTION OF THE DRAWINGS

An exemplary embodiment of the present invention will be described in more detail below and is schematically shown in the drawings, in which.

DETAILED DESCRIPTION

The present invention provides a heating device, in particular for a laundry dryer, including a gas burner and a valve with a gas nozzle, at which primary air can be supplied for the formation of a flame, the heating device further including a tubular heating channel which encloses the flame, and at the inlet opening of which secondary air can be supplied as combustion air, and at the outlet opening of which tertiary air can be mixed with the hot gases; the outlet opening of said heating channel opening into an air duct for the process air.

Figure 1:
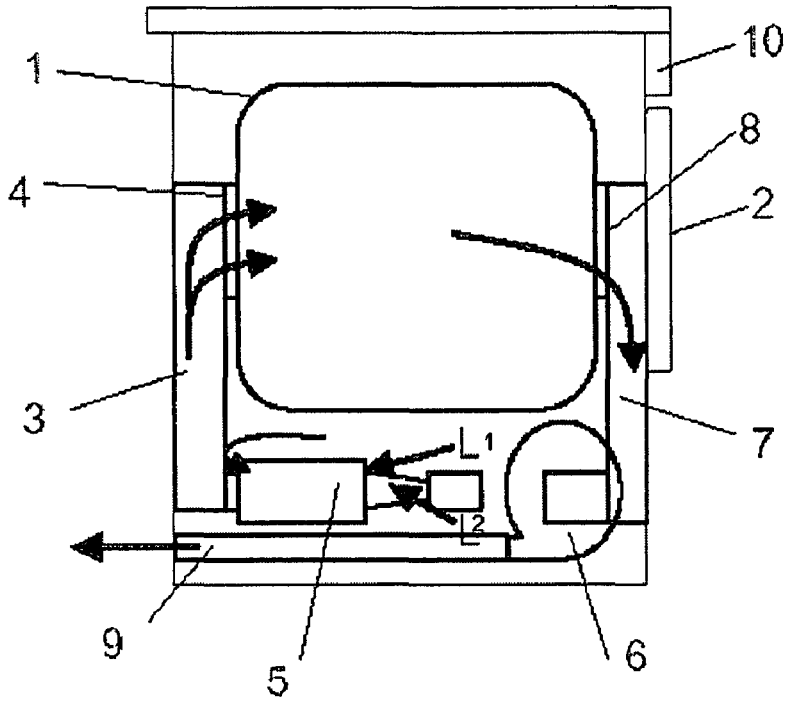
FIG. 1 is a schematic view of the arrangement of gas-heated heating device 5 in a laundry dryer.

The present invention can provide particularly uniform temperature distribution in the heating channel and a compact design of the heating device which, as a module including the heating channel, valve, burner, ignition device, and temperature monitoring means, can be fastened in the laundry dryer and aligned therewith at a single mounting point during assembly. An annular baffle member in the outlet opening causes the flame and the stream of hot air in the heating channel to be centered by the entering secondary air and tertiary air. This prevents contact of the flame with the wall of the heating channel. The temperature profile in the heating channel is uniform and exhibits an overall low temperature level, without any temperature peaks caused by the formation of flow vortices. This has a beneficial effect on the pollutant level in the combustion air FIG. 1 illustrates the construction of a gas-heated laundry dryer, schematically showing the flow paths of the process air and of the combustion air. The laundry dryer has a rotatably mounted drum 1 to receive the laundry to be dried, said drum being closed by a door 2. Gas-heated heating device 5, which is used to heat the drying air, is disposed upstream of the air duct 3 to drum inlet 4. The drying air is drawn in from the surrounding atmosphere in the region of gas-heated heating device 5, and is passed as process air stream through drum 1. A process air fan 6, which is disposed downstream of the air duct 7 connected to drum outlet 8, aspirates the process air and discharges it to the environment through exhaust port 9. User control and display unit 10 allows selection of a drying cycle and display of information on safety features.

Figure 2:
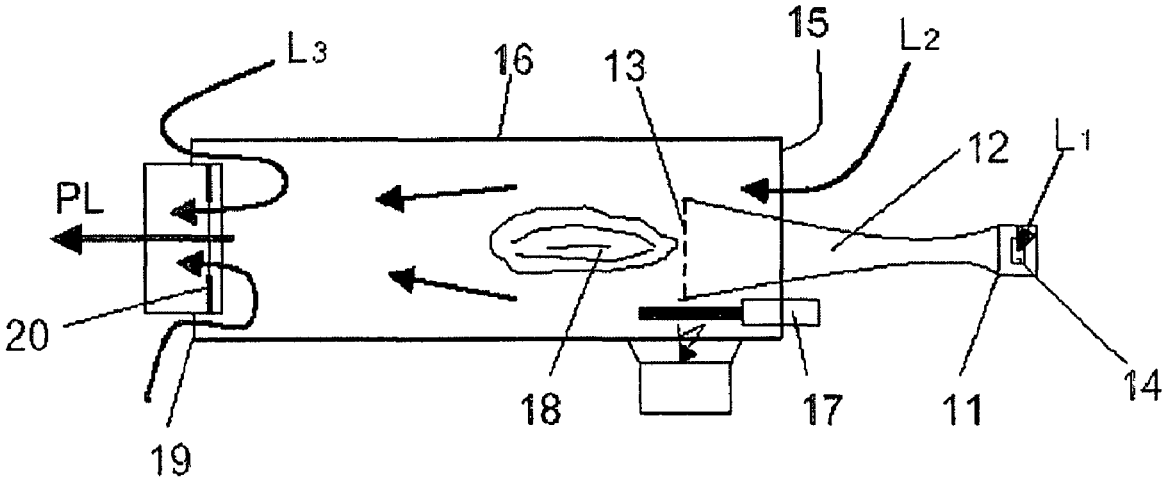
FIG. 2 is a schematic view of gas-heated heating device 5, illustrating the supply of air.

FIG. 2 shows the gas-heated heating device in a schematic view, illustrating the supply of air. Gas burner 11 features a venturi tube 12 having a perforated burner plate 13 mounted on the flame opening thereof. Primary air L1, which is used for the formation of the flame, is drawn in the region of the gas nozzle by the injector effect of the gas nozzle (not specifically shown) and venturi tube 12. The heat of gas burner 11 opens into the inlet opening 15 of heating channel 16. Burner plate 13 has a glow igniter 17 associated therewith. Gas burner 11 is disposed in heating channel 16 such that its axial centerline is eccentrically offset with respect thereto (see also FIG. 4). At the front inlet opening 15 of heating channel 16, secondary air L2 is supplied to flame 18 as combustion air. Due to the construction of heating device 5, the secondary air portion flowing past flame 18 is adapted to modulate the flame without excessively cooling it. This reduces the carbon monoxide content. An annular baffle member 20 is mounted in outlet opening 19 of heating channel 16. In the free cross section between the wall of heating channel 16 and the outer diameter of the baffle member 20, the hot gases are mixed with tertiary air L3 for cooling and passed as a process air stream PL through drum 1 (see FIG. 1). Tertiary air L3 flows into heating channel 16 in a direction opposite to the flame direction, is mixed with the hot gases in heating channel 16 in the region of baffle member 20, and is diverted into the air duct for process air PL. With such an air supply arrangement, the greatest portion of the air for drying the laundry is added downstream of flame 18.

Figure 3:
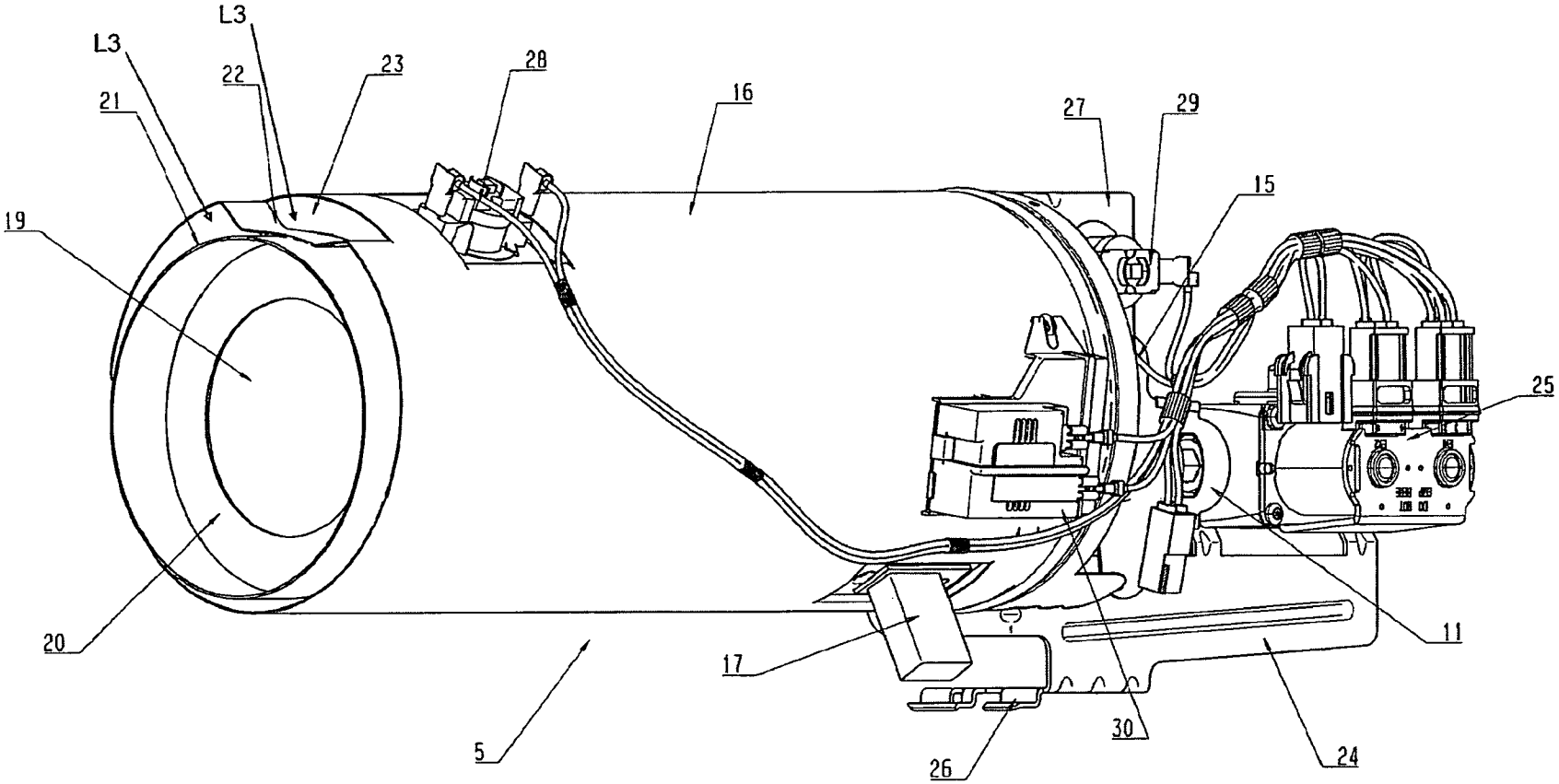
FIG. 3 is a perspective view of heating device 5, looking at outlet opening 19 of heating channel 16.

FIG. 3 shows heating device 5 in a perspective view, looking at outlet opening 19 of heating channel 16. Annular baffle member 20 is mounted eccentrically in outlet opening 19 (see also FIG. 4). Baffle member 20 is provided on its outer diameter with a tubular collar 21 whose outer diameter is smaller than the diameter of heating channel 16. This tubular collar 21 forms the connecting member to the air duct 3 for conveying the process air to drum inlet 4 (see FIG. 1). Baffle member 20 is fixed in outlet opening 19 of heating channel 16 at least one mounting point located on the adjacent surface lines of heating channel 16 and collar 21. Heating channel 16 has at least one inwardly directed bulge 22 which extends to the edge of baffle member 20 and whose wall portion provides a further mounting point for baffle member 20. Bulge 22 extends along a recess made in heating channel 16 in a circumferential direction thereof. The free cross section between the wall of heating channel 16 and the outer diameter of baffle member 20 in the outlet opening 19 at the end face forms the inlet opening for tertiary air L3. The inlet opening has associated therewith a thermostat 28 which is spaced from the inlet opening in a direction toward flame 18 and extends into heating channel 16. Thermostat 28 is responsive to air failure and reduced air intake.

A bracket 24 for valve 25 and gas burner 11 is fastened to heating channel 16 in the lower region of inlet opening 15 such that it lies on an imaginary extension of the bottom surface line. Bracket 24 positions gas burner 11 within inlet opening 15 of heating channel 16, and is formed with a mounting foot 26 for mounting of the entire heating device 5 in a laundry dryer. A mounting tab 27 is located in the upper region of inlet opening 15 such that it lies on an imaginary extension of the top surface line of heating channel 16, said mounting tab fixing gas burner 11 in the vertical cross-sectional plane of heating channel 16 (see also FIG. 4). This mounting tab 27 also holds a thermostat 29 which is disposed in the inflow region of secondary air L2 and is used for detecting fault conditions. Thermostat 29 is located upstream of inlet opening 15 and is responsive to air failure or backflow of air, which may occur when a wind load acts on exhaust port 9 in an exhaust system that does not have a backflow damper, or when process air fan 6 fails. For flame monitoring purposes, glow igniter 17 has associated therewith a sensor thermostat 30 which is responsive to infrared radiation and is located behind a cut-out in the wall of heating channel 16.

Figure 4:
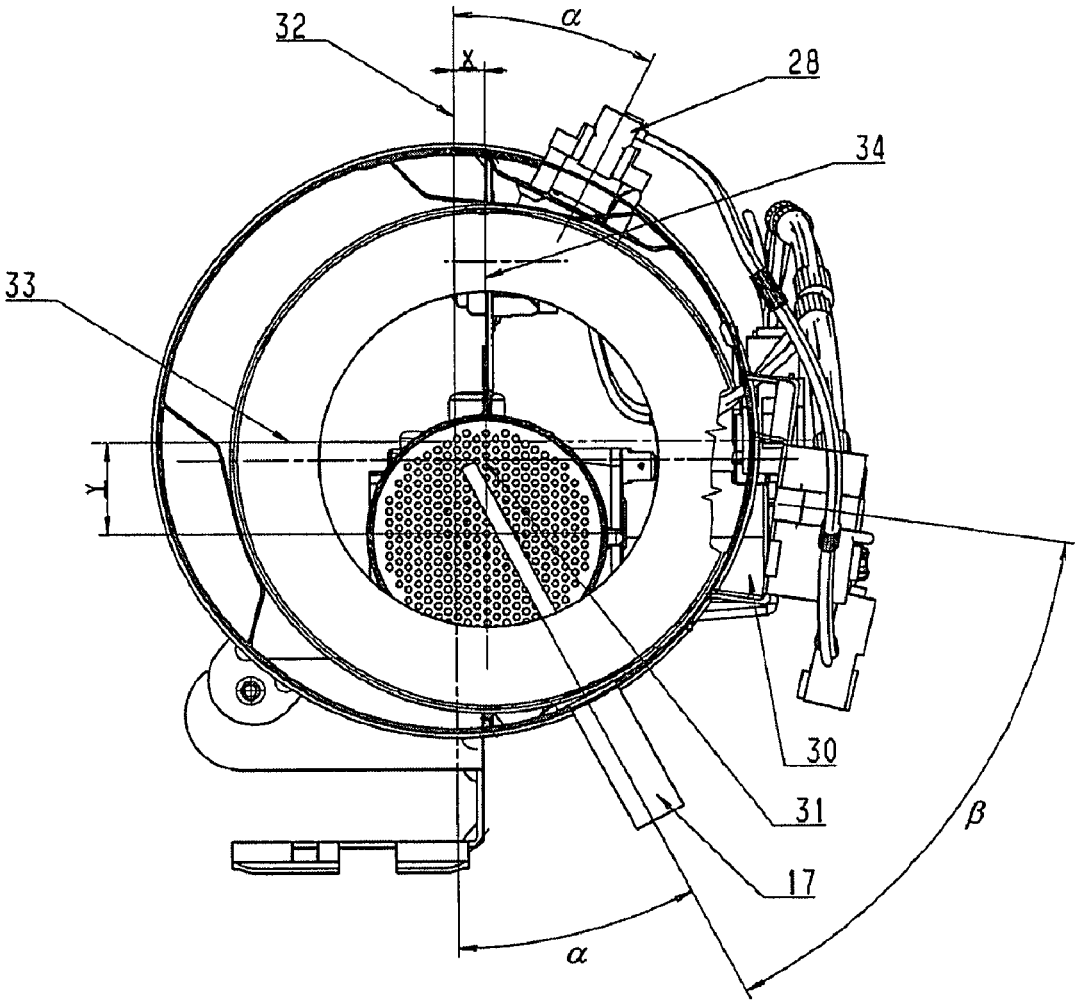
FIG. 4 is a front view of outlet opening 19 of heating channel 16.

FIG. 4 is an elevation view looking at the outlet opening 19 of heating channel 16. In the exemplary embodiment shown, center point 31 of the baffle member 20 is eccentrically offset with respect to vertical centerline 32 and horizontal centerline 33 of outlet opening 19 and heating channel 16. The vertical centerline of burner plate 13 at the head of the gas burner and the vertical centerline of baffle member 20 are located in a common vertical cross-sectional plane 34 of heating channel 16. Vertical cross-sectional plane 34 is parallelly offset by a value X (about 7 mm) from vertical centerline 32 of outlet opening 19 of heating channel 16. The horizontal centerline of burner plate 13 is offset by a value Y (about 7 mm) from centerline 33 of the outlet opening. Thermostat 28 is disposed in the region of the inlet opening for tertiary air L3 on a circumferential line around heating channel 16 at an angle $\alpha$ from vertical centerline 32. Glow igniter 17 is located in the region of burner plate 13 on a circumferential line around the heating channel, preferably at the same angle $\alpha$ (25° to 30°) from vertical centerline 32. Sensor thermostat 30, which is associated with glow igniter 17, is preferably disposed on the periphery of heating channel 16 in the region of horizontal centerline 33. Sensor thermostat 30 is positioned within angle $\beta$ (55° to 60°).

Figures 5, 6:
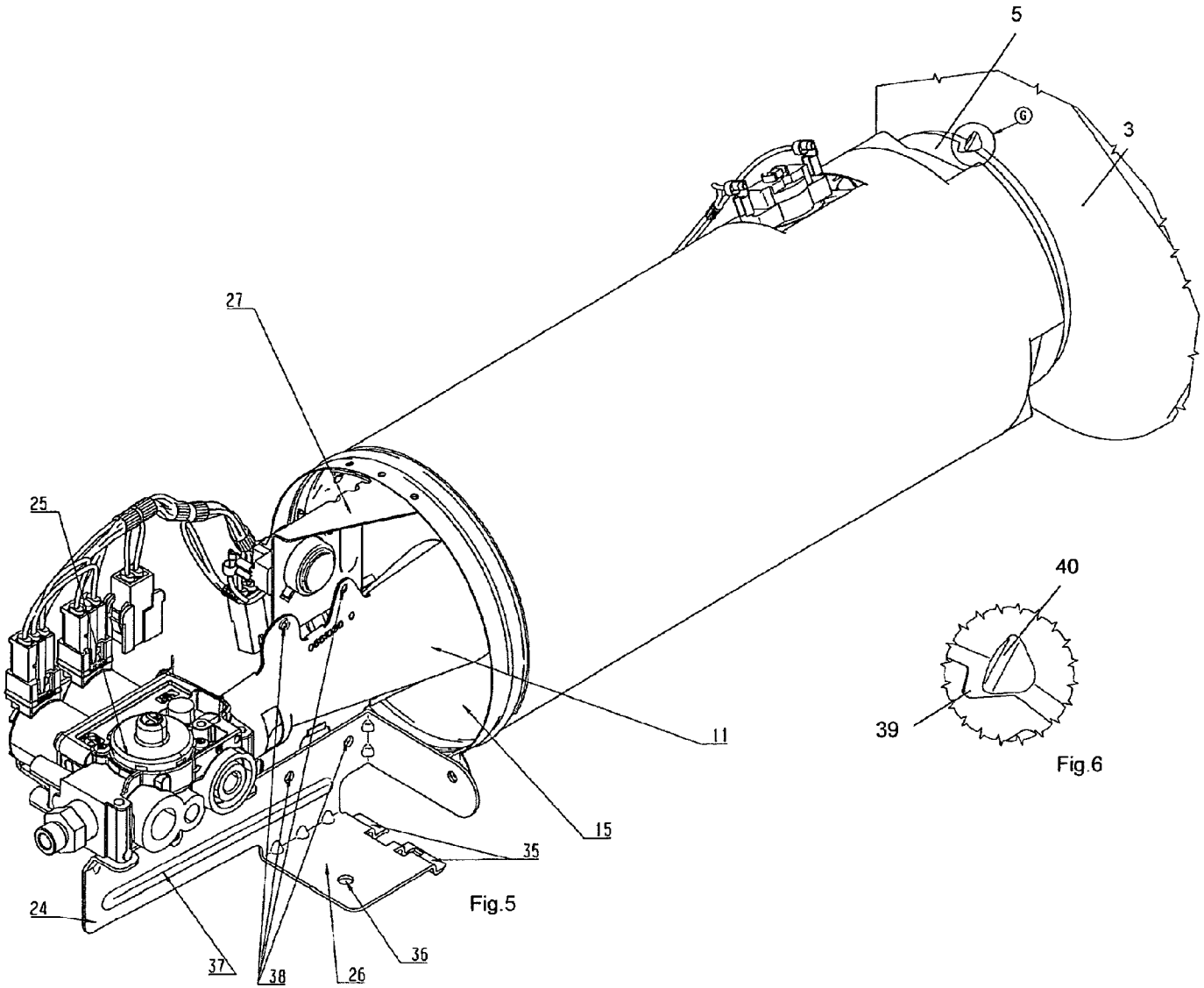
FIG. 5 is a perspective view of heating device 5, looking at the bracket 24 for gas burner 11 and valve 25.
FIG. 6 is a detail view showing the positioning aid 39, 40 used to aid in the positioning of heating device 5 in air duct 3.

In FIG. 5, heating device 5 is shown in a perspective view, looking at the inlet opening of heating channel 16 and bracket 24 for gas burner 11 and valve 25. Bracket 24 includes a mounting foot 26, which has already been described with reference to FIG. 3. Mounting foot 26 is in the form of an angularly extending flange which is integral with bracket 24 and has stepped positioning lugs 35 formed on the edge thereof. Positioning lugs 35 reach behind a receiving structure on the bottom panel of the laundry dryer to hold the entire heating device 5 in its installed position. Heating device 5 may be additionally fixed by a screw connection 36, or the like. For purposes of stability, bracket 24 is formed with a stiffening groove 37 extending in its longitudinal direction. In the exemplary embodiment shown, gas burner 11 is attached to bracket 24 and to mounting tab 27 by means of a permanent connection 38 (clinching, riveting). Valve 25 is mounted as a unit to bracket 24 by means of a separable connection, such as a screw connection (not shown in detail). Thus, the heating device 5 installed in the laundry dryer can be provided with a valve unit that is replaceable for different types of gases. Heating device 5 has a positioning aid in the outlet region 19 of the hot air; i.e., in its connection region to air duct 3, said positioning aid ensuring that heating channel 16, baffle member 20 and gas burner 11 are fixed in the desired position within the appliance. To this end, tubular collar 21 is provided with a v-shaped receiving recess 39 into which snaps a projection 40 provided on air duct 3.

In FIG. 6, the positioning aid 39, 40 used to aid in the positioning of heating device 5 in air duct 3 is shown in an enlarged view.

Thermostat 29 used for detecting fault conditions, which is shown in FIG. 3, can be disposed upstream of the inlet opening also in a different way. For example, thermostat 29 may also be held by separate means associated with inlet opening 15. Such a thermostat 29 can be integrated with little effort into all current laundry dryers having gas burners. The thermostat detects backfiring of flame 18 from inlet opening 15. In the event of a fault, the gas supply to gas burner 11 is immediately interrupted. Preferably, the thermostat is has a manual reset feature.

What is claimed is:

1. A gas-heated laundry dryer having a heating device, the heating device comprising:

a dryer frame housing a drum receiving laundry to be dried;

a gas burner;

a valve with a gas nozzle configured to supply primary air for formation of a flame;

a tubular heating channel configured to enclose the flame, the heating channel including an inlet opening configured to receive secondary air as combustion air and an outlet opening configured to receive tertiary air mixable with hot gases of the burner, the outlet opening being connected to a process air duct of the laundry dryer; and an annular baffle member disposed in the outlet opening of the heating channel and configured to center, by the secondary and tertiary air, at least one or the flame and a hot air stream in the channel, wherein a center point of the baffle member is eccentrically offset with respect to at least one of a vertical centerline and a horizontal centerline of the outlet opening;

wherein a vertical centerline of the baffle member and a vertical centerline of a flame exit opening and a burner plate at a head of the gas burner are disposed in a common vertical cross-sectional plane of the heating channel and wherein the horizontal center line of the flame exit opening and the burner plate of the gas burner and the horizontal center line of the baffle member are vertically offset.

2. The gas-heated laundry dryer as recited in claim 1 wherein the baffle member includes an outer diameter and a tubular collar disposed at an outer diameter thereof, the tubular collar having a respective outer diameter that is smaller than a diameter of the heating channel.

3. The gas-heated laundry dryer as recited in claim 2 wherein the tubular collar is connected to the process air duct downstream of the heating channel.

4. The gas-heated laundry dryer as recited in claim 2 wherein the tubular collar includes a receiving recess configured to receive a projection of the process air duct so as to aid in position the heating device with respect to the process air duct.

5. A gas-heated laundry dryer having a heating device, the heating device comprising:

dryer frame housing a drum receiving laundry to be dried;

a gas burner;

a valve with a gas nozzle configured to supply primary air for formation of a flame;

a tubular heating channel configured to enclose the flame, the heating channel including an inlet opening configured to receive secondary air as combustion air and an outlet opening configured to receive tertiary air mixable with hot gases of the burner, the outlet opening being connected to a process air duct of the laundry dryer; and an annular baffle member disposed in the outlet opening of the heating channel and configured to center, by the secondary and tertiary air, at least one or the flame and a hot air stream in the channel, wherein a vertical centerline of the baffle member. a vertical centerline of a flame exit opening and a burner plate at a head of the gas burner are disposed in a common vertical cross-sectional plane of the heating channel, and wherein the vertical cross-sectional plane is offset from a vertical centerline of the heating channel by a predetermined value and wherein the heating tube and burner are attached independent of the dryer frame.

6. The gas-heated laundry dryer as recited in claim 1 wherein the heating channel and the collar have adjacent surface lines and the baffle member is fixed in the outlet opening of the heating channel at least one mounting point at the adjacent surface lines.

7. The gas-heated laundry dryer as recited in claim 1 wherein the heating channel includes at least one inwardly directed bulge extending to an edge of the baffle member, the at least one inwardly directed bulge having a wall portion providing a mounting point for the baffle member.

8. The gas-heated laundry dryer as recited in claim 7 wherein the at least one inwardly extending bulge extends along a recess in the heating channel in a circumferential direction of the heating channel.

9. The gas-heated laundry dryer as recited in claim 1 wherein a cross section between a wall of the heating channel and an outer diameter of the baffle member in a vicinity of the outlet opening forms an inlet opening for the tertiary air.

10. The gas-heated laundry dryer as recited in claim 9 wherein the inlet opening for the tertiary air is configured such that the tertiary air flows into the heating channel in a direction opposite a direction of the flame, is mixed with the hot gases in the heating channel in a vicinity of the baffle member, and is directed into the process air duct.

11. A gas-heated laundry dryer having a heating device, the heating device comprising:

a gas burner;

a valve with a gas nozzle configured to supply primary air for the formation of a flame;

a tubular heating channel configured to enclose the flame, the heating channel including an inlet opening configured to receive secondary air as combustion air and an outlet opening configured to receive tertiary air mixable with hot gases of the burner, the outlet opening being connected to a process air duct of the laundry dryer;

an annular baffle disposed in the outlet of the heating channel;

a bracket configured to hold the valve and gas burner, the bracket being fastened to a lower region of the inlet opening of the heating channel so as to lie on an imaginary extension of a bottom surface line of the heating channel, the bracket including a mounting foot that is integral with the bracket and has a form of an angularly extending flange, the mounting foot including stepped positioning lugs at an edge thereof, the positioning lugs configured to extend behind a receiving structure on a bottom panel of the laundry dryer so as to secure the heating device in an installed position; and a mounting tab disposed on an upper region of the heating channel so as to lie in an imaginary extension of a top surface line of the heating channel and configured to fix the gas burner in a vertical cross-sectional plane of the heating channel.

12. The gas-heated laundry dryer as recited in claim 11 wherein the mounting foot is configured to mount the heating device in the laundry dryer.

13. The gas-heated laundry dryer as recited in claim 11 further comprising at least one permanent connection attaching the gas burner to at least one of the bracket and mounting tab.

14. The gas-heated laundry dryer as recited in claim 11 further comprising a temperature sensor disposed on the mounting tab.

15. The gas-heated laundry dryer as recited in claim 11 wherein the valve is detachably fixed to the bracket.

16. The gas-heated laundry dryer as recited in claim 14 wherein the temperature sensor includes a thermostat disposed upstream of the inlet opening and configured to detect fault conditions.

* * * * *